United States Patent [19]

Krizan et al.

[11] 3,982,690

[45] Sept. 28, 1976

[54] MAIL BOX CONTAINER

[75] Inventors: Bradford J. Krizan, Plymouth; James L. Pfaffendorf, Maple Grove, both of Minn.

[73] Assignee: Liberty Carton Co., Minneapolis, Minn.

[22] Filed: Sept. 27, 1974

[21] Appl. No.: 509,922

[52] U.S. Cl. ..... 232/17

[51] Int. Cl.[2] ..... B65D 91/00

[58] Field of Search ..... 232/17, 31, 32, 30, 232/43.2, 38; 220/DIG. 6, DIG. 14, 1 T, 73, 94 A; 229/23 R, 23 C, 6 A

[56] References Cited

UNITED STATES PATENTS

| | | | |
|---|---|---|---|
| 422,717 | 3/1890 | Caldwell | 220/94 A |
| 2,243,625 | 5/1941 | Gettleman | 220/73 X |
| 2,341,150 | 2/1944 | Locke | 229/23 C |
| 2,421,221 | 5/1947 | Rothe | 232/30 |
| 2,443,713 | 6/1948 | Anderson | 229/23 R |
| 2,555,926 | 6/1951 | Hendrick | 220/73 |
| 2,567,832 | 9/1951 | Vadner | 229/23 R |
| 2,613,839 | 10/1952 | Coles, Jr. | 220/73 X |
| 2,732,993 | 1/1956 | Anderson | 229/23 C |
| 2,917,220 | 12/1959 | Bostock | 229/23 R |
| 3,341,060 | 9/1967 | Rehrig | 220/73 |
| 3,395,859 | 8/1968 | Menges | 232/43.2 |

*Primary Examiner*—James T. McCall

*Attorney, Agent, or Firm*—Williamson, Bains & Moore

[57] ABSTRACT

A portable, open top, mail collecting container constructed and shaped from lightweight material for removable insertion inside of a mail collection box through the box access door. The upper edges of the container incline downwardly from the rear end wall towards the front end wall to facilitate insertion in and removal through the restricted access opening in the side of a mailbox. A moisture impervious bottom wall on the container is provided with liquid drainage apertures and is supported on vertically extending projections to permit any liquid which might fall into the container to drain through the bottom and to protect mail collected in the container from exposure to moisture when the container is rested on the ground in the course of handling. The upright side and end walls of the container are preferably formed from a single piece of fiberboard which is cut and scored to be folded to a substantially rectangular shape; and the bottom portion of the container takes the form of a moisture impervious base tray having upstanding side and end panels affixed to the bottom ends of the upright fiberboard walls.

9 Claims, 7 Drawing Figures

MAIL BOX CONTAINER

BRIEF SUMMARY OF THE INVENTION

The container of this invention is particularly characterized by its light weight, durability, ease of handling and distinctive functional shape which render it especially well suited to the unique function of removable insertion within an ordinary corner main collecting box for collecting and transporting mail.

Designed to be quickly and easily inserted within and removed from mail collection boxes presently in widespread use, the container catches deposited mail. The postal carrier simply opens the side access door of a collection box, removes the filled container and replaces it with an empty one. The filled container is dumped into a hamper in the collection truck, and is then used to replace the filled container at the next collection box as the postal carrier continues his pickup rounds. This simplified collection procedure eliminates the heretofore time-consuming and tedious process of gathering and bagging the mail at each collection box.

The container is advantageously formed so that the upper edges of its side walls incline downwardly from its rear, end wall towards its front end wall, thereby facilitating the insertion of the shorter front end of the container within the side access openings of mail boxes. Such access openings are normally restricted by their hinged access doors, which do not swing all of the way down to a horizontal position. To prevent liquids such as drinks and beverages of various kinds which are sometimes dumped into mail collection boxes by vandals from standing in the portable collection container and damaging the mail accumulated therein, the bottom wall of the container is provided with drainage apertures and has vertically extending protrusions on which it is supported above the bottom of the mail box.

A particularly beneficial aspect of the mail collecting container resides in its construction from a unique combination of corrugated fiberboard and plastic which provide a lightweight, easy to handle container without sacrificing strength and durability. The upper portion of the container is preferably formed from a single piece of pre-cut and scored fiberboard folded to a substantially rectangular shape to provide upright side and end walls. The upper, fiberboard portion of the container is held in this shape by securing the free ends of the fiberboard piece together along a generally vertically extending joint between the end extremities of one of the fiberboard walls. Hinged flaps formed on the upper ends of each of the fiberboard walls of the container are secured in downwardly folded positions in which they serve to retain a rigid reinforcing rim positioned around the upper periphery of the container to lend strength and rigidity. Intermediate portions of the reinforcing rim disposed above open, cutaway segments of each of the end walls of the container serve as hand grips.

The bottom portion of the container preferably takes the form of a base tray molded from moisture impervious plastic to provide a bottom panel and upstanding side and end panels which overlap the bottom ends of the upright fiberboard walls and are attached thereto. The plastic bottom adds durability to the container and protects against moisture.

These and other objects and advantages of our invention will become readily apparent as the following description is read in conjunction with the accompanying drawings wherein like reference numerals have been used to designate like elements throughout the several views.

DESCRIPTION OF THE PREFERRED EMBODIMENT

Figures 1, 2, 3, 4, 5, 6, 7:
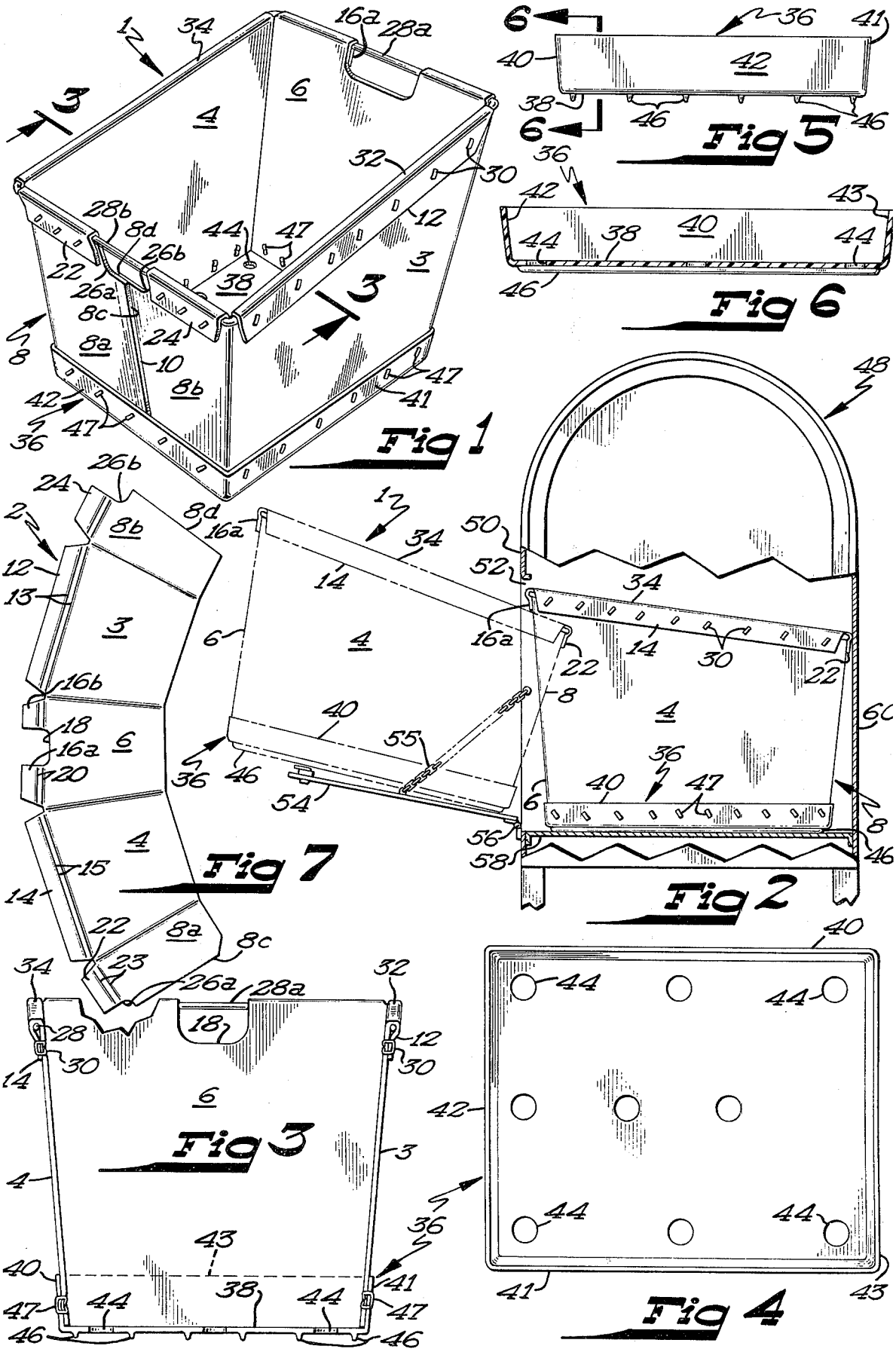
FIG. 1 is a perspective view of the mail box container of this invention.
FIG. 2 is a side elevation view, partially in section, showing the manner of insertion and positioning of the portable container within a mail collection box.
FIG. 3 is a vertical section view of the mail box container taken along lines 3—3 of FIG. 1.
FIG. 4 is a top, plan view of the base tray of the container.
FIG. 5 is an end, elevation view of the container base tray.
FIG. 6 is a vertical section view of the container base tray taken along lines 6—6 of FIG. 5.
FIG. 7 is a plan view of the fiberboard piece from which the upper portion of the container is formed.

Referring now to the drawings, I have shown in FIG. 1 a perspective view of the preferred structure of the portable mail container of this invention. The container is generally indicated by reference numeral 1, and preferably has an upper portion formed from a single piece of corrugated, fiberboard material 2, which is pre-cut and scored in the manner shown in FIG. 7. Fiberboard blank 2 is divided into segments as shown in FIG. 7, separated by score lines, to provide a pair of opposed, upright side walls 3 and 4 and a pair of upright, end walls 6 and 8 when fiberboard piece 2 is folded to the rectangular shape shown in FIG. 1. The free ends **8*a* and 8*b* of fiberboard piece 2 are joined together along a substantially vertical joint 10 to form end wall 8. The end extremities 8*c* and 8*d* of end wall segments 8*a* and 8*b* are overlapped as shown in FIG. 1 and secured together by any suitable means to form joint 10**, a glue joint being preferred.

As may best be understood by reference to FIGS. 1 and 7, each of the fiberboard walls 3, 4, 6 and 8 has a hinged flap formed along its upper end. Flaps 12 and 14 on the upper ends of side walls 3 and 4 are hingedly attached thereto along double score lines 13 and 15 as shown in FIG. 7. For reasons hereinafter explained, the hinged flap on the upper end of end wall 6 is comprised of two, spaced apart flap segments **16*a* and 16*b* separated by a cutaway segment or notch 18. Double score lines 20 form a hinge connection between flap segments 16*a*, 16*b* and end wall 6. End wall segment 8*a* has a hinged flap 22 on its upper end joined to it along double score lines 23; and a similar flap segment 24 is hingedly attached to the upper end of the other end wall segment 8*b* along double score lines 25. End wall segments 8*a* and 8*b* are notched at their upper, outer corners as shown at 26*a* and 26*b* in FIGS. 1 and 7 so as to provide a continuous, cutaway segment at the upper end of end wall 8 in the middle thereof, above joint 10 as shown in FIG. 1**.

In order to add strength and rigidity to container 1, a wire reinforcing rim 28 is positioned around the upper periphery thereof. Rigid rim 28 is held in place in abutting engagement with the upper edges of the fiberboard side and end walls by downwardly folded flaps 12, 14, **16*a*–16*b*, 22 and 24. FIGS. 1 and 3 illustrate the manner in which these flaps are folded downwardly and outwardly along their respective hinge lines in overlapping relation to the upper ends of the fiberboard side and end walls to define pockets within which reinforcing rim 28 is contained. The downwardly folded flaps are secured to their respective side and end walls 3, 4, 6 and 8 by staples 30.** Other suitable means of attachment may be used for this purpose, such as stitching or riviting.

As a particularly advantageous feature of our mail collecting container, reinforcing rim 28 is used to provide hand grips on the opposite ends of container 1. This is accomplished by providing the cutaway or notched portions 18 and 26*a*, 26*b* in opposed end walls 6 and 8, substantially centrally thereof. Intermediate portions 28*a* and 28*b* of reinforcing rim 28 disposed along the opposite ends of container 1, directly above the cutaway end wall portions 18 and 26*a*, 26*b*, serve as hand grips by means of which container 1 may be handled and carried. It is also important to note that vertical joint 10 formed in the fiberboard upper wall portion 2 of the container is located between the upright end extremities of end wall 8, with the upper end of joint 10 terminating at the bottom of open, cutaway segment 26*a*, 26*b*. Since there is no downwardly folded, upper flap, and thus only a single thickness of material at this location along end wall 8, the forming and securing of joint 10 between the overlapping ends 8*c* and 8*d* of end wall segments 8*a* and 8*b* is greatly simplified.

As is most clearly indicated in FIGS. 1 and 2, the upper edges 32 and 34 of upright side walls 3 and 4 incline forwardly and downwardly from rear end wall 6 towards the opposite, front end wall 8. As a result, rear end wall 6 is of course higher than front end wall 8. The inclining of the top edges of the side walls of container 1 in this manner greatly facilitate the insertion of the container in mail boxes, as is described below with respect to FIG. 2.

Although the bottom wall of container 1 could also be made out of fiberboard, as is the upper portion, we have found it particularly desirable and advantageous to form the bottom portion of the container from a semi-rigid moisture impervious base tray generally indicated by reference numeral 36 in FIGS. 4, 5 and 6. High density polyethelene has proven to be a particularly satisfactory material for base tray 36 to provide the desired properties of lightweight, hardness, durability and moisture imperviousness. Base tray 36 is preferably molded as an integral unit from such plastic material to form a bottom wall 38 and upstanding side and end panels 40, 41 and 42, 43 respectively. Base tray 36 is fitted over the bottom end of the upright, fiberboard portion 2 of container 1 in the manner shown in FIGS. 1 and 3. The upper, fiberboard portion 2 of the container rests inside of base tray 36, with the base tray side walls 40, 41 and end walls 42, 43 overlapping the bottom ends of the upright, fiberboard side walls 3, 4 and end walls 6, 8. Staples 47 are used to secure the base tray upstanding walls 40, 41 and 42, 43 to the bottom ends of the fiberboard walls 3, 4 and 6, 8. It will be appreciated that other means of attachment, such as, could or stitches culd be used for this purpose.

A plurality of liquid drainage apertures 44 are provided in bottom wall 38; and, a plurality of vertically extending protrusions 46 project downwardly from bottom wall 38 and serve to support it above the surface on which container 1 is resting. Protrusions 46 preferably take the form of elongated ribs as shown in FIGS. 5 and 6 which extend generally lengthwise of base tray 36 parallel to side walls 40 and 41. The function of these structural features of base tray 36 is noted below with respect to the description of the manner of use of the mail box container 1.

Referring now to FIG. 2, we have shown a mail collection box 48 of the type in widespread use. Such corner mailboxes conventionally have an upper, mail insertion opening (not shown) and an access opening in one side wall. As in shown in FIG. 2, side wall 50 of mail collection box 48 has an access opening 52 which is normally closed by a hinged door 54. Support chains 55 hold access door 54 in the downwardly swung position to which door 54 may be swung about its hinge 56, as shown in FIG. 2. The hinged access doors 54 and their support chains 55 are so constructed and arranged on many mailboxes that access door 54 will be in a slightly upwardly inclined position when swung fully open as shown in FIG. 2. Since door 54 is not in a straight, horizontal position, the access through opening 52 is somewhat restricted. Inclined upper edges 32 and 34 on container 1 permit it to be inserted through such an access opening, and removed therethrough with a minimum of difficulty. This is accomplished by inserting shorter, front end 8 of container 1 through opening 52 first. Higher, rear end wall 6 of container 1 has a predetermined height such that it will expand substantially the entire height of access opening 52. This is done to prevent mail dropped into the container from falling between container end wall 6 and access door 54. With container 1 inserted inside of mail collection box 48 in the aforesaid manner, and resting on the collection box bottom wall 48, the shorter, front end wall 8 of container 1 will be positioned next to back wall 60 of collection box 48, opposite access opening 52. The higher, rear end wall 6 of container 1 will be positioned next to access opening 52. Hand grip 28*a* will of course also be disposed next to access opening 52, and greatly facilitates the insertion of container 1 through access opening 52, and its removal therethrough.

As may be noted by reference to FIG. 2, bottom ribs 46 on container 1 will support base wall 38 above the bottom wall or floor 58 of mail collection box 48. Thus, as all to often happens, liquid of any kind dumped into mail collection box 48 by vandals will not accumulate and stand within container 1. Any such liquid poured into mail collection box 48 will drain through openings 44 in bottom wall 38, and onto the floor 48 of collection box 48. This feature greatly lessens the possibility of liquid damage to mail collected in container 1 inside of a mail collection box. Also, the moisture impervious qualities of container bottom wall 38 protect the collected mail in the bottom of container 1 against the effects of moisture of any kind in which container 1 might be resting. For example, when a postman removes a filled container 1 from inside of a mail collection box such as that shown in 48, it may be necessary for him to rest the filled container 1 on the ground while he is inserting an empty container 1 into the collection box. If there is snow or moisture on the ground, moisture impervious base tray 36, with its upwardly turned side and end walls 40, 41 and 42, 43 will protect the contents of container 1 against moisture damage. It is also to be noted that elongated ribs 46, extending lengthwise along the bottom 38 of container 1 serve as skids on which container 1 may be pulled along the ground, or any floor surface in the course of handling. Not only do these tough, plastic bottom ribs 46, as well as the entire base tray 36 facilitate the sliding movement of container 1 along the ground, or any floor surface, they also protect the container against damage in the course of handling, and greatly enhance the life of the container.

In use, an empty one of the containers 1 is inserted within mail collection boxes of the type shown at 48 in FIG. 2. Container 1 will fit snuggly inside the collection box in the manner shown in FIG. 2 so as to collect all mail dropped into the box. As the postal carrier makes his rounds, he simply opens access door 54 and removes the filled container 1 from the collection box 48 through access opening 52. An empty container 1 is then inserted through access opening 52, with the shorter end wall 8 first, and access door 54 is closed. The removed, filled container is then taken to the postman's truck and dumped into a hamper in the inside of the truck, this container then serving as the empty container to be placed in the next mail collection box from which a filled container is removed. It will be appreciated that this elimination of the normal bagging procedure at each mail collection box has a number of advantages. First of all, there is a considerable time saving in the entire mail collection process which experience has shown amounts to approximately 10 minutes an hour. secondly, the carrier is protected from possible foreign and dangerous objects sometimes dropped into collection boxes by vandals. Since the carrier does not have to directly handle the mail, as has been the procedure in the past in manually scooping mail out of collection boxes into a bag, there is no risk of the carrier injuring his hands by contact with broken glass or other foreign objects which might find their way into mail collection boxes.

As noted above, moisture impervious bottom wall 38 of base tray 36 protects the mail in the container from moisture damage, and is highly wear resistant to handling and sliding on the ground. In addition to serving as slide skids, ridges 46 formed on bottom wall 38 lend strength and rigidity to the bottom of the container. Although polyethelene is the preferred plastic material from which base tray 36 is molded, other plastic materials having the qualities of moisture resistance and resistance to becoming brittle in cold weather may also be suitable for the forming of the container bottom wall. Also, it is contemplated that the entire container might be made from other materials than those disclosed herein. For example, the entire container could be molded as a one piece plastic container having the apertured and ribbed bottom wall described above. Alternatively, the container could be made completely from fiberboard. However, such an all-fiberboard container would not have the water resistance, durability and protection against moisture which is achieved by using the plastic base tray 36 in combination with an upper, fiberboard container portion disclosed herein.

We anticipate that various other changes may be made in the size, shape and construction of the mail box container herein disclosed without departing from the spirit and scope of our invention as defined by the following claims.

What is claimed is:

1. A material handling container comprising:

an upright portion formed from a single piece of fiberboard which is cut, scored and folded to form a pair of opposed, upright side walls and a pair of opposed, upright end walls extending therebetween, the upper and bottom edges of said side and end walls defining an open top and open bottom of the container, and said upright fiberboard portion being held in a generally rectangular shape by a substantially vertical joint formed between the free ends of said fiberboard piece between the end extremities of one of said upright walls;

a bottom portion in the form of a semi-rigid, moisture impervious, shallow base tray comprised in its entirety of a bottom panel extending between said upright side and end walls, and upstanding side and end panels overlapping only the bottom ends of said upright side and end walls and attached thereto, said base tray being formed as a unitary structure from a single piece of material, and the bottom edges of said upright, figerboard side and end walls abutting flush against the top face of said tray bottom panel;

a hinged flap on each of said side and end walls defined by score lines extending lengthwise of said side and end walls below the top extremities thereof, said flaps being folded downwardly along said hinge lines in overlapping relation to said side and end walls and attached thereto to define pockets on the upper ends of said side and end walls;

a completely cutaway segment at the top of each of said container end walls defining hand grip openings completely open across the top thereof and bounded by said overlapping flaps and pockets on each side thereof;

a rigid reinforcing rim of rectangular shape contained within said pockets and extending around the top of said container; and a pair of hand grips on opposite ends of said container formed by intermediate gripping portions of said reinforcing rim along opposite ends thereof disposed across the top of said hand grip openings, and the free ends of said single piece of fiberboard forming said side and end walls overlapping and being secured together along a substantially vertically extending joint formed in one of said end walls between the upright and extremities thereof, the upper end of said joint terminating at the bottom of the hand grip opening of said end wall spaced below one of said gripping portions of said reinforcing rim where there is no downwardly folded flap and thus only a single wall thickness of said free ends of overlap and secure together.

2. A container as defined in claim 1 wherein:

the free ends of said signal piece of fiberboard comprise a pair of end wall segments which form said one end wall when secured together along said joint said single piece of fiberboard being scored to form five panels with said pair of end wall segments being at the opposite, free ends thereof and three interior panels therebetween which serve as said opposite side walls and the other end wall; and a notch at the top of the outer, joint forming, edge of each of said end wall segments, said notches extending to the top horizontal edge of each of said end wall segments and cooperating to define a continuous hand grip opening at the top of said one end wall when said pair of end wall segments are secured together along said joint.

3. A container as defined in claim 2 wherein:

said joint between said pair of end wall segments is substantially centrally located along the length of said one end wall.

4. In combination with a mail collection box having an upper, mail insertion opening and a hinged door in one wall thereof providing access to the interior of said box, a mail collection container inside of said box, comprising:

an upright container having a bottom wall, a pair of opposed, upright side walls and a pair of opposed, upright end walls extending upwardly from said bottom wall and forming together a substantially rectangular container, said side and end walls of said container being formed from a single piece of fiberboard which is cut, scored and folded to a generally rectangular shape;

an open top on said container defined by the upper edges of said side and end walls, the upper edges of said side walls inclining forwardly and downwardly from the rear end wall of said container towards the opposite, front wall thereof, whereby the rear, end wall of said container is higher than the front, end wall, and said container being removably positioned inside of said mail collection box with said container rear end wall disposed next to said hinged access door and said container front, end wall being disposed next to the wall of said mail box opposite said access door;

a separate, moisture impervious base tray having said bottom wall of said container as an integral segment thereof and having upstanding side and end panls overlapping only the bottom end portions of said container side and end walls and attached thereto;

a plurality of liquid drainage apertures extending through said container bottom wall of said base tray; and a plurality of vertically extending protrusions projecting downwardly from said bottom wall of said container base tray and formed integrally therewith to support said container bottom wall above the bottom of said mail collection box on which said container rests.

5. A material handling container comprising:

an upright portion formed from a single piece of fiberboard which is cut, scored and folded to form a pair of opposed, upright side walls and a pair of opposed, upright end walls extending therebetween, the upper and bottom edges of said side and end walls defining an open top and open bottom of the container, and said upright fiberboard portion being held in a generally rectangular shape by a substantially vertical joint formed between the free ends of said fiberboard piece between the end extremities of one of said upright walls;

a bottom portion in the form of a semi-rigid, moisture impervious, shallow base tray comprised in its entirety of a bottom panel extending between said upright side and end walls, and upstanding side and end panels overlapping only the bottom ends of said upright side and end walls and attached thereto, said base tray being formed as a unitary structure from a single piece of material;

said single piece of fiberboard being of arc-like configuration when extended in a single plane and being scored along fold line connections so oriented between said side and end walls that said side and end walls will assume an upwardly and outwardly inclined configuration with single bends at the corners of said upright portion along said fold line connections, and with the bottom edges of said side and end walls terminating above said bottom panel in a horizontal plane;

a hinged flap on each of said side and end walls defined by score lines extending lengthwise of said side and end walls below the top extremities thereof, said flaps being folded downwardly along said hinge lines in overlapping relation to said side and end walls and attached thereto to define pockets on the upper ends of said side and end walls;

a cutaway segment at the top of each of said container end walls defining hand grip openings bounded by said overlapping flaps and pockets on each side thereof;

a rigid reinforcing rim of rectangular shape contained within said pockets and extending around the top of said container; and a pair of hand grips on opposite ends of said container formed by intermediate gripping portions of said reinforcing rim along opposite ends thereof disposed across the top of said hand grip openings, and the free ends of said single piece of fiberboard forming said side and end walls overlapping and being secured together along a substantially vertically extending joint formed in one of said end walls between the upright end extremities thereof, the upper end of said joint terminating at the bottom of the hand grip opening of said end wall spaced below one of said gripping portions of said reinforcing rim where there is no downwardly folded flap and thus only a single wall thickness of said free ends to overlap and secure together.

6. A container as defined in claim 5 wherein:

the bottom edges of said side and end walls abut flat against the top face of said bottom panel.

7. A container as defined in claim 5 wherein:

the bottom ends of said side and end walls lie flush against the unstanding side and end panels of said base tray in face to face contact therewith.

8. A container as defined in claim 1 wherein:

a plurality of liquid drainage apertures extend through said bottom panel; and a plurality of vertically extending protrusions projecting downwardly from said bottom panel and serving to support said bottom panel above the surface on which said container is resting, said protrusions being formed integrally with said bottom panel.

9. A container as defined in claim 8 wherein:

said base tray is molded as a unitary piece from high density polyethylene.

* * * * *

UNITED STATES PATENT AND TRADEMARK OFFICE

CERTIFICATE OF CORRECTION

PATENT NO. : 3,982,690

DATED : September 28, 1976

INVENTOR(S) : Bradford J. Krizan and James L. Pfaffendorf

It is certified that error appears in the above-identified patent and that said Letters Patent are hereby corrected as shown below:

In claim 1, line 15, change "figerboard" to --fiberboard--.

In claim 1, line 48, change "of overlap" to -- to overlap.

In claim 2, line 50, change "signal" to --single--.

In claim 4, line 30, change "panls" to --panels--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*